US010319329B2

(12) United States Patent
Jeon et al.

(10) Patent No.: US 10,319,329 B2
(45) Date of Patent: Jun. 11, 2019

(54) GATE DRIVING CIRCUIT, LEVEL SHIFTER, AND DISPLAY DEVICE

(71) Applicant: SILICON WORKS CO., LTD., Daejeon (KR)

(72) Inventors: Hyun Jin Jeon, Daejeon (KR); Jin Soo Byeon, Daejeon (KR); Ji Hun Kim, Daejeon (KR); Young Jin Woo, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 15/711,928

(22) Filed: Sep. 21, 2017

(65) Prior Publication Data

US 2018/0090095 A1 Mar. 29, 2018

(30) Foreign Application Priority Data

Sep. 28, 2016 (KR) ..... 10-2016-0125058

(51) Int. Cl.
*G09G 3/36* (2006.01)
*G09G 3/20* (2006.01)

(52) U.S. Cl.
CPC ..... *G09G 3/3688* (2013.01); *G09G 3/20* (2013.01); *G09G 2300/0408* (2013.01); *G09G 2300/0439* (2013.01); *G09G 2310/0267* (2013.01); *G09G 2310/0289* (2013.01)

(58) Field of Classification Search
CPC ..... G09G 3/3688; G09G 3/20; G09G 2310/0267; G09G 2310/0289; G09G 2300/0439; G09G 2300/0408
See application file for complete search history.

(56) References Cited

U.S. PATENT DOCUMENTS 8,405,595 B2 3/2013 Cho
2013/0314392 A1* 11/2013 Kim ..... G09G 3/20 345/212

FOREIGN PATENT DOCUMENTS

KR 10-2011-0075413 A 7/2011
KR 10-2015-0074613 A 7/2015
KR 10-2016-0092145 A 8/2016

* cited by examiner

*Primary Examiner* — Andrew Sasinowski
(74) *Attorney, Agent, or Firm* — Fenwick & West LLP

(57) ABSTRACT

The present invention attenuates noise appearing at neighboring electrodes by causing a rising edge of one clock signal to be synchronized with a falling edge of another one clock signal when a clock signal for gate driving is generated.

16 Claims, 20 Drawing Sheets

GATE DRIVING CIRCUIT, LEVEL SHIFTER, AND DISPLAY DEVICE

CROSS REFERENCE TO RELATED APPLICATION

This application claims priority from Republic of Korea Patent Application No. 10-2016-0125058, filed on Sep. 28, 2016, which is hereby incorporated by reference in its entirety.

BACKGROUND

1. Field of Technology

The present embodiment relates to a display device. More particularly, the present embodiment relates to a technology for driving a gate line of a display device.

2. Description of the Prior Art

A plurality of data lines and gate lines are arranged on a display panel, and pixels may be defined by the intersection of the data line and the gate line.

Each pixel includes a transistor, and the transistor is turned on by a gate driving signal supplied to the gate line.

When the transistor is turned on, the data line is connected to a pixel and a data voltage is supplied to the pixel. In addition, the brightness of the pixel changes according to the magnitude of the data voltage, and an image is displayed on the display panel under a control of the brightness of the pixel.

Meanwhile, a gate driving signal is generated based on a plurality of clock signals, and noise appears at a rising edge and a falling edge of a clock signal in a display panel or a peripheral circuit.

A gate line to which the gate driving signal is supplied is coupled to electrodes disposed on the display panel or peripheral circuits, by capacitance or the like. Through the coupling, the rising edge and the falling edge of the clock signal may propagate to the display panel or the peripheral circuit while generating noise.

SUMMARY

In this background, the embodiments are to provide a technology for minimizing noise generated by a clock signal.

In view of the above, an embodiment provides a gate driving circuit.

The gate driving circuit may include a control signal reception unit, a level shifting unit, and a gate driving signal supplying unit.

In addition, the control signal reception unit included in the gate driving circuit may receive a first clock control signal and a second clock control signal from a timing controller. The level shifting unit may generate a plurality of clock signals, each of which may include at least one voltage rising section, which is formed in synchronization with a first clock control signal, and at least one voltage falling section, which is formed in synchronization with a second clock control signal, and each of the clock signals may have a voltage level different from those of the first clock control signal and the second clock control signal. In addition, the gate driving signal supply unit may supply a gate driving signal, which is generated according to the plurality of clock signals, to a plurality of gate lines arranged on the display panel.

In addition, each of the gate lines may be coupled to one electrode disposed on the display panel by capacitance, and one voltage rising section of one clock signal of the plurality of clock signals may be synchronized to one voltage falling section of another one clock signal.

In relation to a node from which each clock signal is output, the level shifting unit may connect the node to an intermediate stage voltage through a resistor in a first voltage rising section, and connect the node to a high voltage in a second voltage rising section.

The level shifting unit may connect a node from which one clock signal is output and a node from which another one clock signal is output, through a resistor, in the one voltage rising section of one clock signal and the one voltage falling section of another one clock signal.

The first voltage rising section of one or more voltage rising sections may be formed in synchronization with a rising edge of a first clock control signal, and the second voltage rising section may be formed in synchronization with a falling edge of the first clock control signal.

The first voltage falling section of one or more voltage falling section may be formed in synchronization with a rising edge of a second clock control signal, and the second voltage falling section may be formed in synchronization with a falling edge of the second clock control signal. Here, one voltage rising section of the one clock signal described above may be synchronized with the first voltage falling section or the second voltage falling section of another one clock signal.

A plurality of clock signals are configured such that two stages of the first voltage rising section and the second voltage rising section are formed, two stages of the first voltage falling section and the second voltage falling section are formed, and the first voltage rising section and the second voltage rising section of one clock signal may be synchronized with the first voltage falling section and the second voltage falling section of another one clock signal, respectively.

Another embodiment provides a level shifter including a control signal reception unit and a level shifting unit.

The control signal reception unit may receive a first clock control signal and a second clock control signal from a timing controller. Further, the level shifting unit may generate a plurality of clock signals, each of the clock signals may include at least one voltage rising section, which is formed in synchronization with a first clock control signal, and at least one voltage falling section, which is formed in synchronization with a second clock control signal, and each of the clock signals may have a voltage level different from those of the first clock control signal and the second clock control signal.

In addition, gate driving signals which are generated according to the plurality of clock signals may be supplied to a plurality of gate lines arranged on a display panel, each of the gate lines may be coupled to one electrode disposed on the display panel by capacitance, and one voltage rising section of one clock signal of the plurality of clock signals may be synchronized with one voltage falling section of another one clock signal.

Still another embodiment provides a display device including a timing controller, a display panel, and a gate driving circuit.

The timing controller may transmit a first clock control signal and a second clock control signal. Further, the display panel may include a plurality of gate lines coupled to one electrode by capacitance. In addition, the gate driving circuit may generate a plurality of clock signals and provide gate driving signals generated according to the plurality of clock signals to the plurality of gate lines, wherein each of the clock signals may include at least one voltage rising section, which is formed in synchronization with a first clock control signal, and at least one voltage falling section, which is formed in synchronization with a second clock control signal, and each of the clock signals may have a voltage level different from those of the first clock control signal and the second clock control signal.

According to the embodiment described above, the present invention has an effect of minimizing noise generated by clock signals.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION

Figure 1:
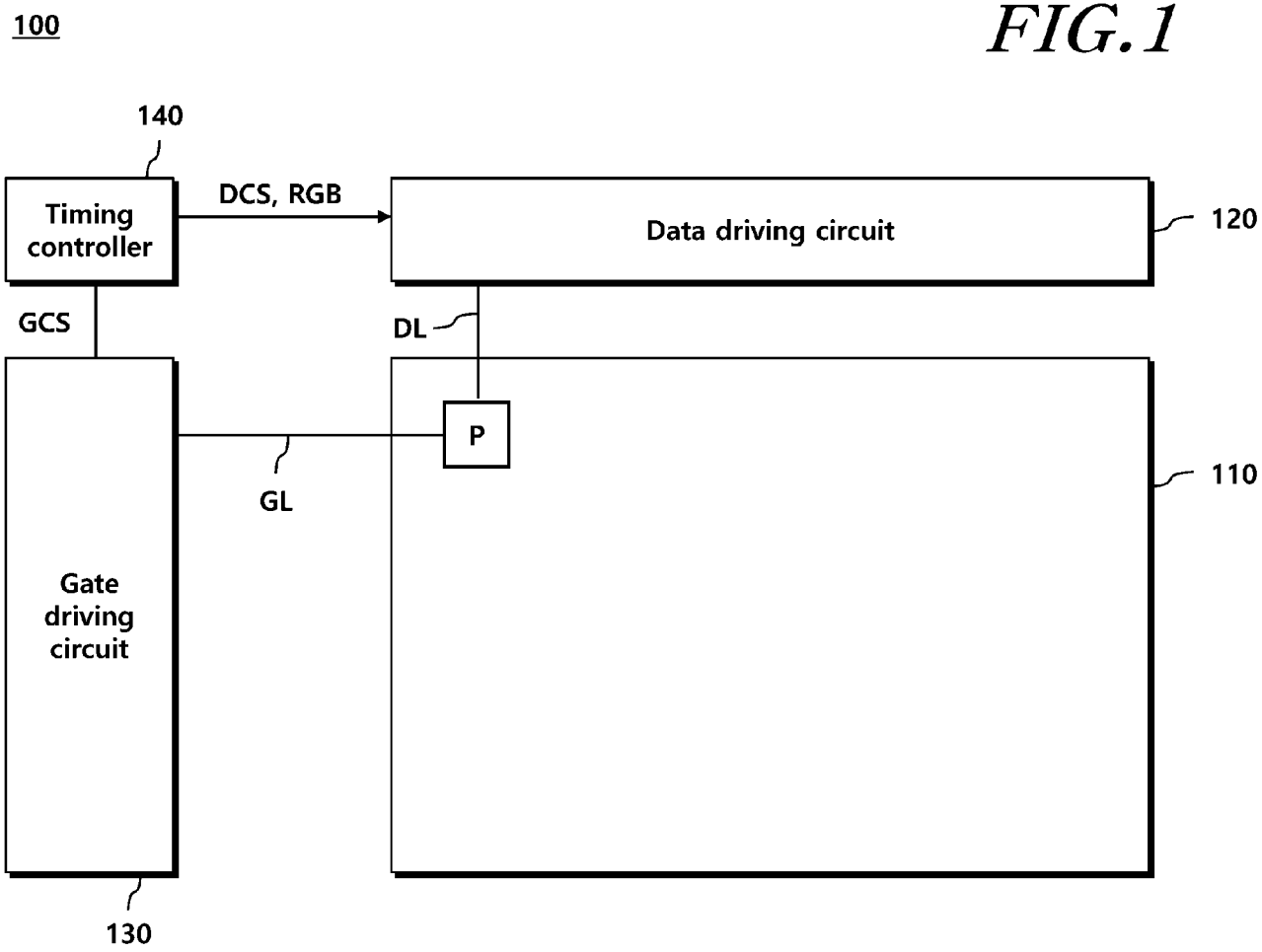
FIG. 1 is a block diagram of a display device according to an embodiment.

Hereinafter, embodiments of the present disclosure will be described in detail with reference to the accompanying drawings. In adding reference numerals to elements in each drawing, the same elements will be designated by the same reference numerals, if possible, although they are shown in different drawings. Further, in the following description of the present invention, a detailed description of known functions and configurations incorporated herein will be omitted when it is determined that the description may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component.

FIG. 1 is a block diagram of a display device according to an embodiment.

Referring to FIG. 1, a display device 100 may include a display panel 110, a data driving circuit 120, a gate driving circuit 130, a timing controller 140, and the like.

A plurality of data lines DL and a plurality of gate lines GL may be disposed on the display panel 110 and a plurality of pixels P may be disposed thereon.

The gate driving circuit 130 may supply a gate driving signal having a turn-on voltage or a turn-off voltage to the gate line GL. When the gate driving signal having the turn-on voltage is supplied to a pixel P, the pixel P is connected to the data line DL. In addition, when the gate driving signal of the turn-off voltage is supplied to a pixel P, the pixel P and the data line DL are disconnected.

The data driving circuit 120 supplies a data voltage to the data line DL. The data voltage supplied to the data line DL is supplied to a pixel P according to the gate driving signal.

The timing controller 140 may supply a control signal to the gate driving circuit 130 and the data driving circuit 120. For example, the timing controller 140 may transmit a gate control signal GCS for starting the scan to the gate driving circuit 130. Then, the timing controller 140 may output image data RGB to the data driving circuit 120. In addition, the timing controller 140 may transmit a data control signal DCS that controls the data driving circuit 120 to supply the data voltage to each pixel P.

The display panel 110 may be a liquid crystal display panel. The display panel 110 may be another type of panel, such as an organic light emitting diode (OLED) panel. However, hereinafter, for the convenience of explanation, an embodiment in which the display panel 110 is a liquid crystal display panel will be described.

The liquid crystal display panel may include an array substrate including a transistor, an upper substrate including a color filter and/or a black matrix, etc. and a liquid crystal material layer formed therebetween. In such a liquid crystal display panel, the alignment state of the liquid crystal layer is adjusted according to the electric field applied between a pixel electrode and a common electrode provided in a pixel region, and accordingly the transmittance of light is adjusted so as to display an image.

A display area including one or more pixels for displaying an image and a non-display area are defined on an array substrate, and a pixel P is defined by the intersection of a plurality of gate lines GL and a plurality of data lines DL in a display area of an array substrate, which is typically called as a lower substrate. In addition, a thin film transistor (TFT) is provided at each intersection and is connected to a transparent pixel electrode formed on each pixel Pin a one-to-one relationship.

In order to form the thin film transistor TFT, the gate line GL, the data line DL, and the like, a plurality of layers, such as a gate metal layer, a semiconductor layer, a source/drain metal layer, a pixel electrode layer, and a common electrode layer, etc. are formed in the array substrate, and an interlayer insulating layer or a protective layer for insulation or protection between the layers may be formed.

On the other hand, various neighboring electrodes (for example, a data line, a pixel electrode, a common electrode, and the like) as described above are located around the gate line GL disposed on the display panel 110, and the gate line GL may be coupled to the neighboring electrodes by capacitance.

In addition, the clock signal transmitted to the gate line GL may generate noise in the neighboring electrodes through the capacitive coupling.

The gate driving circuit 130 according to an embodiment generates a clock signal such that noise propagated through the gate line GL is minimized.

Figure 2A:
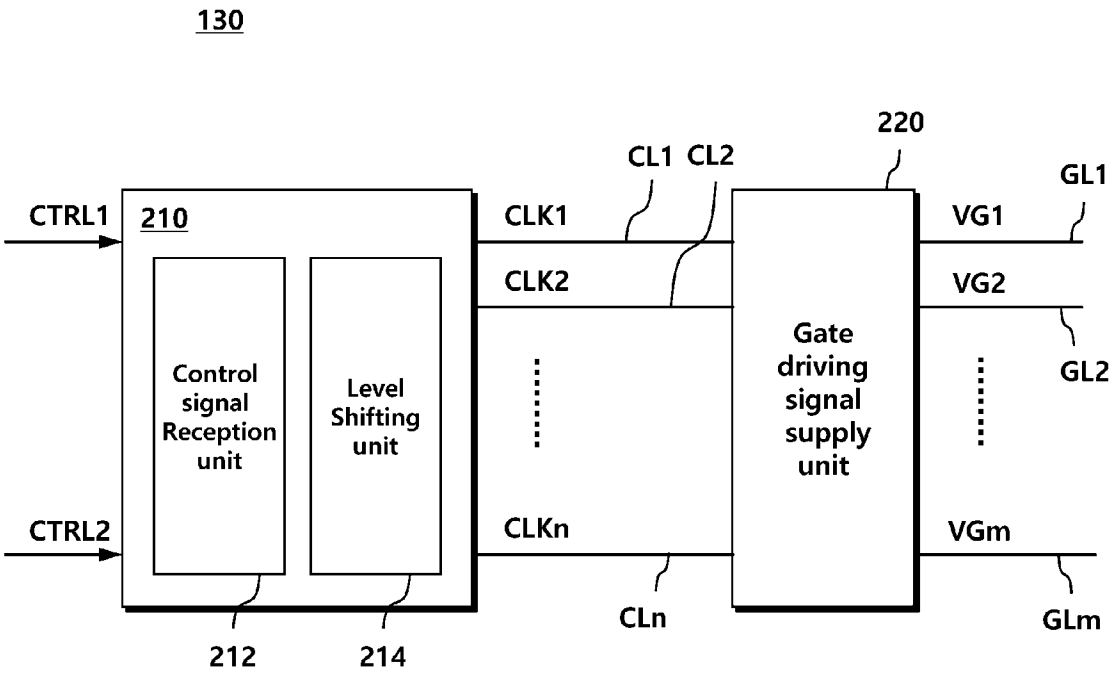
FIG. 2A is a block diagram of a gate driving circuit according to an embodiment.
Figure 2B:
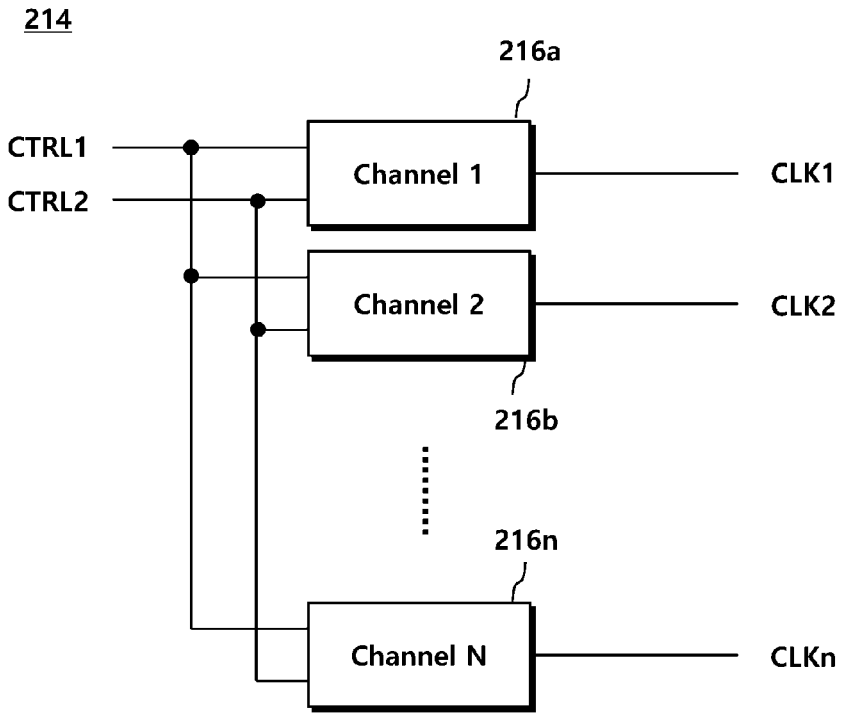
FIG. 2B is a block diagram of a level shifting unit of a gate driving circuit according to an embodiment.
Figure 2C:
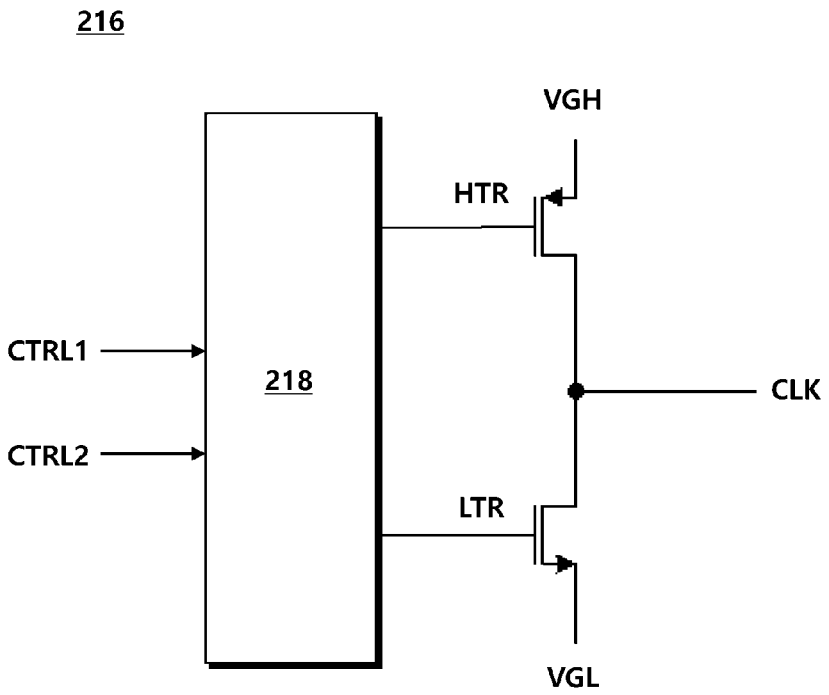
FIG. 2C is a block diagram of a channel of a level shifting unit according to an embodiment.

FIG. 2A is a block diagram of a gate driving circuit according to an embodiment, FIG. 2B is a configuration of a level shifting unit of a gate driving circuit according to an embodiment, and FIG. 2C is a block diagram of a channel of a level shifting unit according to an embodiment.

Referring to FIG. 2A, the gate driving circuit 130 may include a clock generation unit 210 and a gate driving signal supply unit 220.

The clock generation unit 210 generates a plurality of clock signals (CLK1, CLK2, . . . , CLKn).

The clock generation unit 210 may include a control signal reception unit 212 for receiving clock control signals CTRL1 and CTRL2 from a timing controller, and a level shifting unit 214 for generating a plurality of clock signals (CLK1, CLK2, . . . , CLKn) having voltage levels different from those of the clock control signals CTRL1 and CTRL2.

In an aspect of including the level shifting unit 214, the clock generation unit 210 may be referred to as a level shifter.

The level shifting unit 214 may form a voltage rising section, for example, a rising edge, of the clock signals (CLK1, CLK2, . . . , CLKn) according to a first clock control signal CTRL1 received from the timing controller, and form a voltage falling section, for example, a falling edge, of the clock signals (CLK1, CLK2, . . . , CLKn) according to a second clock control signal CTRL2. According to this method, the level shifting unit 214 may generate three or more clock signals (CLK1, CLK2, . . . , CLKn) by receiving only two clock control signals CTRL1 and CTRL2.

Referring to FIG. 2B, the level shifting unit 214 may include N (N is a natural number) channels (216*a*, 216*b*, . . . , 216*n*) forming each of the clock signals (CLK1, CLK2, . . . , CLKn).

Each of the channels (216*a*, 216*b* . . . 216*n*) may receive the clock control signals CTRL1 and CTRL2 and generate the clock signals (CLK1, CLK2, . . . , CLKn) one after another, using the clock control signals CTRL1 and CTRL2.

Referring to FIG. 2C, a channel 216 may include an upper transistor HTR connected to a high voltage line VGH, a lower transistor LTR connected to a low voltage line VGL, and a channel controller 218 for controlling the upper transistor HTR and the lower transistor LTR.

The channel controller 218 controls on/off of the upper transistor HTR and the lower transistor LTR by using the clock control signals CTRL1 and CTRL2. A clock signal CLK having a high voltage is output when the upper transistor HTR is turned on, and a clock signal CLK having a low voltage is output when the lower transistor LTR is turned on.

Referring again to FIG. 2A, the gate driving signal supply unit 220 generates gate driving signals (VG1, VG2, . . . , VGm) by using the clock signals (CLK1, CLK2, . . . , CLKn). In addition, the gate driving signal supply unit 220 supplies the generated gate driving signals (VG1, VG2, . . . , VGm) to the gate lines (GL1, GL2, . . . , and GLm).

The clock signals (CLK1, CLK2, . . . , CLKn) are transmitted to the gate driving signal supply unit 220 through clock lines (CL1, CL2, . . . , CLn), and the clock signals (CLK1, CLK2, . . . , CLKn) may generate noise in the neighboring electrodes while passing through the clock lines (CL1, CL2, . . . , CLn) and the gate lines (GL1, GL2, . . . , GLm).

Figure 3:
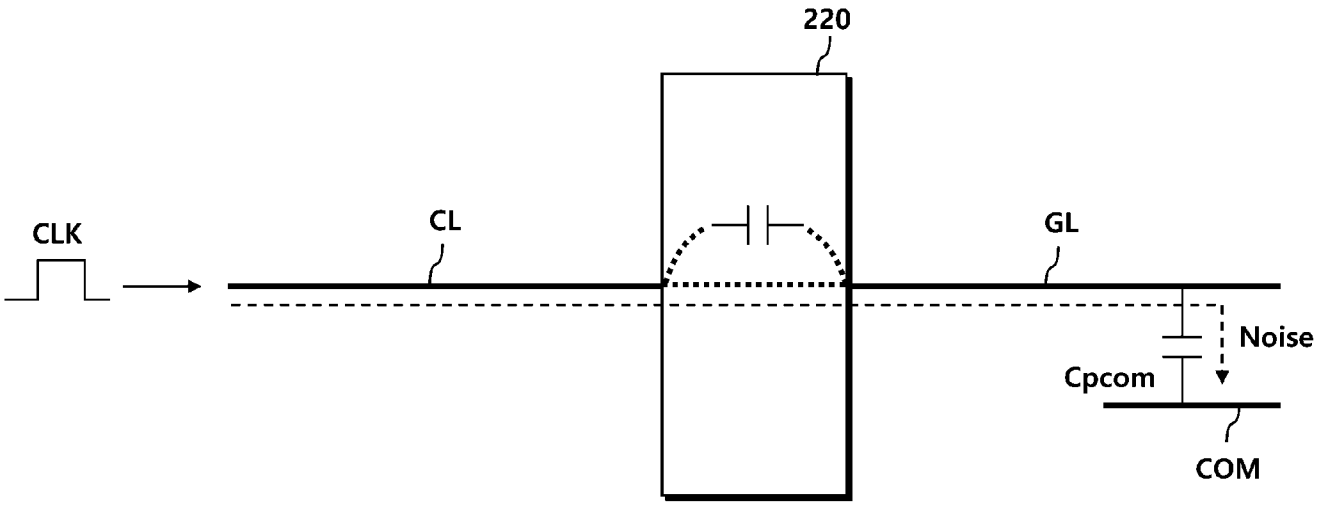
FIG. 3 is a diagram illustrating noise propagated to a common electrode by a clock signal.

FIG. 3 is a diagram illustrating noise propagated to a common electrode by a clock signal.

Referring to FIG. 3, a clock signal CLK is transferred to the gate driving signal supply unit 220 through a clock line CL.

The gate driving signal supply unit 220 may connect the clock line CL with the gate line GL in a certain time period, and the clock signal CLK may propagate to the gate line GL in the time period. In addition, the clock line CL may be coupled to the gate line GL by capacitance, through which the clock signal CLK may propagate to the gate line GL.

The gate line GL may be coupled to neighboring electrodes by capacitance. For example, as shown in FIG. 3, the gate line GL may be coupled to the common electrode COM by parasitic capacitance Cpcom.

The clock signal CLK transmitted to the clock line CL may propagate to the common electrode COM through the gate line GL and the parasitic capacitance Cpcom so as to generate noise in the common electrode COM.

Figure 4:
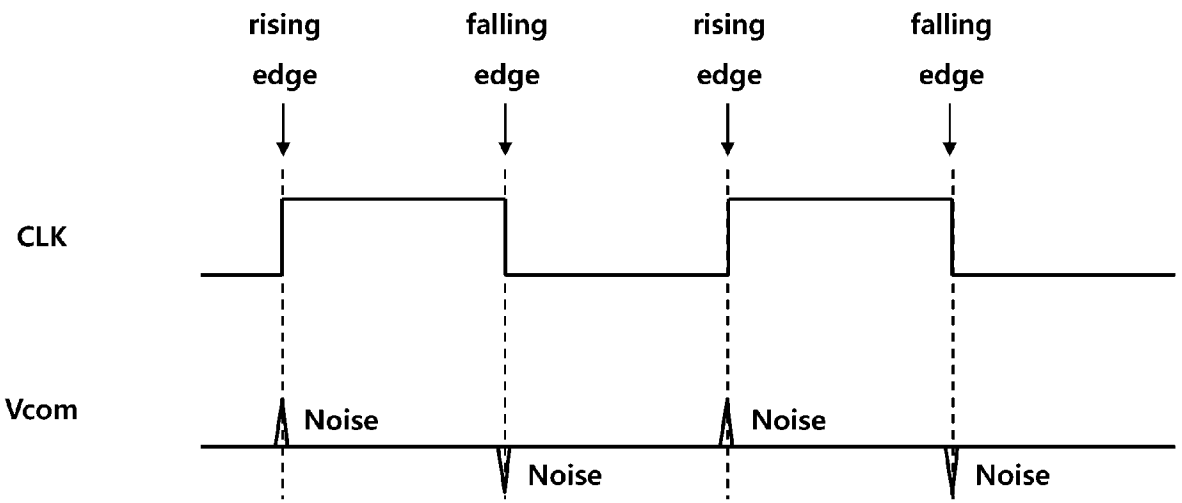
FIG. 4 is a diagram illustrating noise formed in a common electrode by a clock signal.

FIG. 4 is a diagram illustrating noise formed in a common electrode by a clock signal.

Referring to FIG. 4, noise may be generated in the common electrode voltage Vcom at a variation time point (a rising edge and a falling edge) of a voltage level of the clock signal CLK.

Since the clock signal CLK propagates mainly to the neighboring electrodes through the capacitive coupling, the clock signal CLK generates no noise in the neighboring electrodes during a period during which there is no voltage variation, and generates noise in the neighboring electrodes at a time point at which the voltage level changes.

Meanwhile, referring to FIG. 4, it is noted that noise in the common electrode voltage Vcom is generated in a rising edge and a falling edge of the clock signal CLK in different directions, respectively. The gate driving circuit 130 according to an embodiment generates a clock signal such that a voltage rising section of one clock signal, for example, a rising edge, is synchronized to a voltage falling section of another clock signal, for example, a falling edge, in order to attenuate noise. When the clock signal is controlled as described above, the noise generated during a voltage rising section of one clock signal, for example, a rising edge, is canceled out by the noise generated during the voltage falling section of another clock signal, for example, a falling edge, so that noise generated in the neighboring electrodes (for example, the common electrode) can be attenuated.

In the present specification, a rising edge is an example of a voltage rising section, and a falling edge is an example of a voltage falling section, but not all the voltage rising sections are rising edges and not all the voltage falling sections are falling edges.

Figure 5:
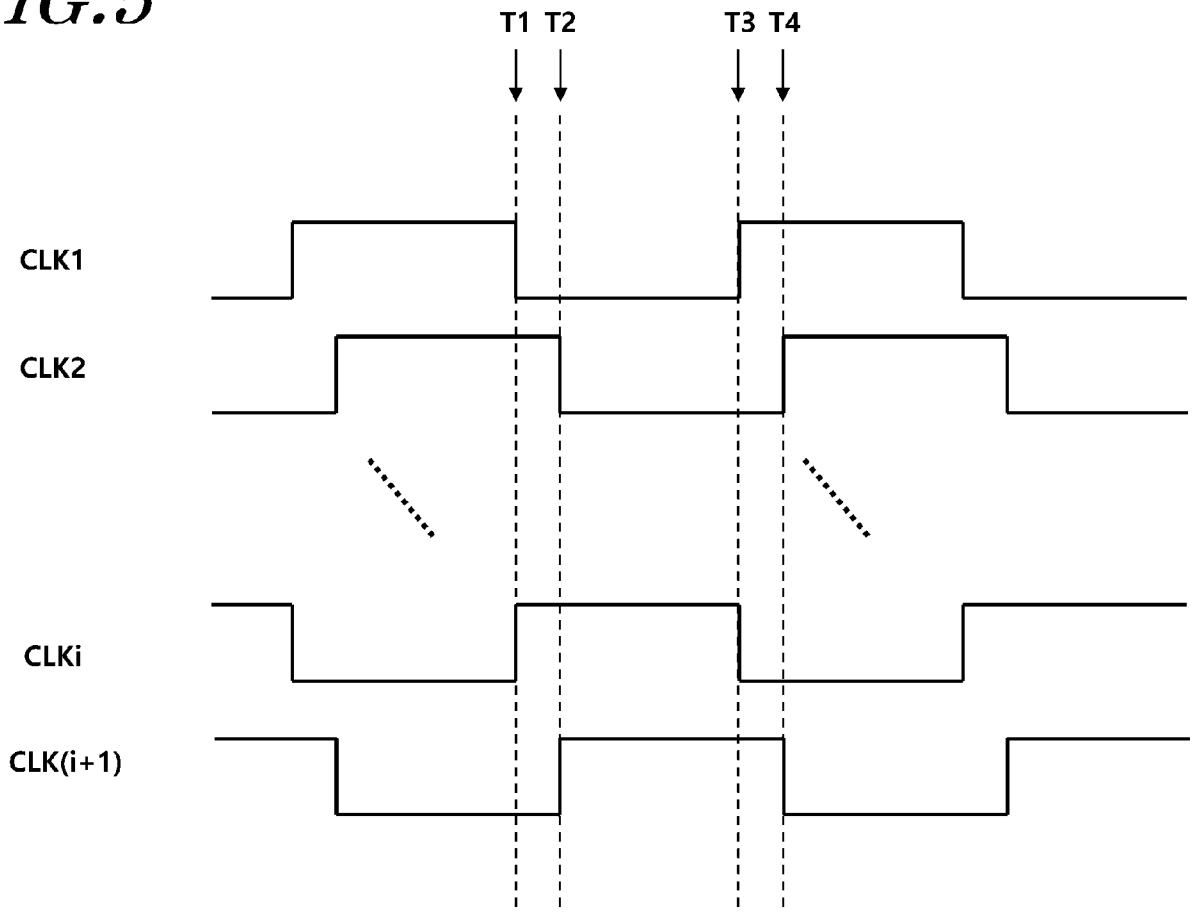
FIG. 5 is a diagram illustrating a waveform of a clock signal according to an embodiment.

FIG. 5 is a diagram illustrating a waveform of a clock signal according to an embodiment.

Referring to FIG. 5, a rising edge of one clock signal is synchronized with a falling edge of another clock signal.

For a specific example, a rising edge of the i-th clock signal CLKi is synchronized with a falling edge of the first clock signal CLK1, at the first time point T1. In addition, a rising edge of the (i+1)-th clock signal CLK (i+1) is synchronized with a falling edge of the second clock signal CLK2, at the second time point T2. As such, in relation to the plurality of clock signals generated by the gate driving circuit, rising edges of one clock signal may be synchronized with falling edges of another clock signal.

Two clock signals are paired with each other so that the voltage rising section and the voltage falling section may be synchronized. For example, the first clock signal CLK1 may be paired with the i-th clock signal CLKi, and a rising edge of the i-th clock signal CLKi may be synchronized with a falling edge of the first clock signal CLK1, at the first time point T1, and a rising edge of the first clock signal CLK1 may be synchronized with a falling edge of i-th clock signal CLKi, at the third time point T3. As another example, the second clock signal CLK2 may be paired with the (i+1)-th clock signal CLK(i+1), and a rising edge of the (i+1)-th clock signal CLK(i+1) may be synchronized with a falling edge of the second clock signal CLK2, at the second time point (T2), and on the contrary, a rising edge of the second clock signal CLK2 may be synchronized with a falling edge of the (i+1)-th clock signal CLK(i+1), at the fourth time point (T4).

Since noise in a rising edge and a falling edge of a clock signal may generate in different directions, when a rising edge of one clock signal and a falling edge of another clock signal are synchronized with each other, noise cancellation at the neighboring electrode may occur.

Figure 6:
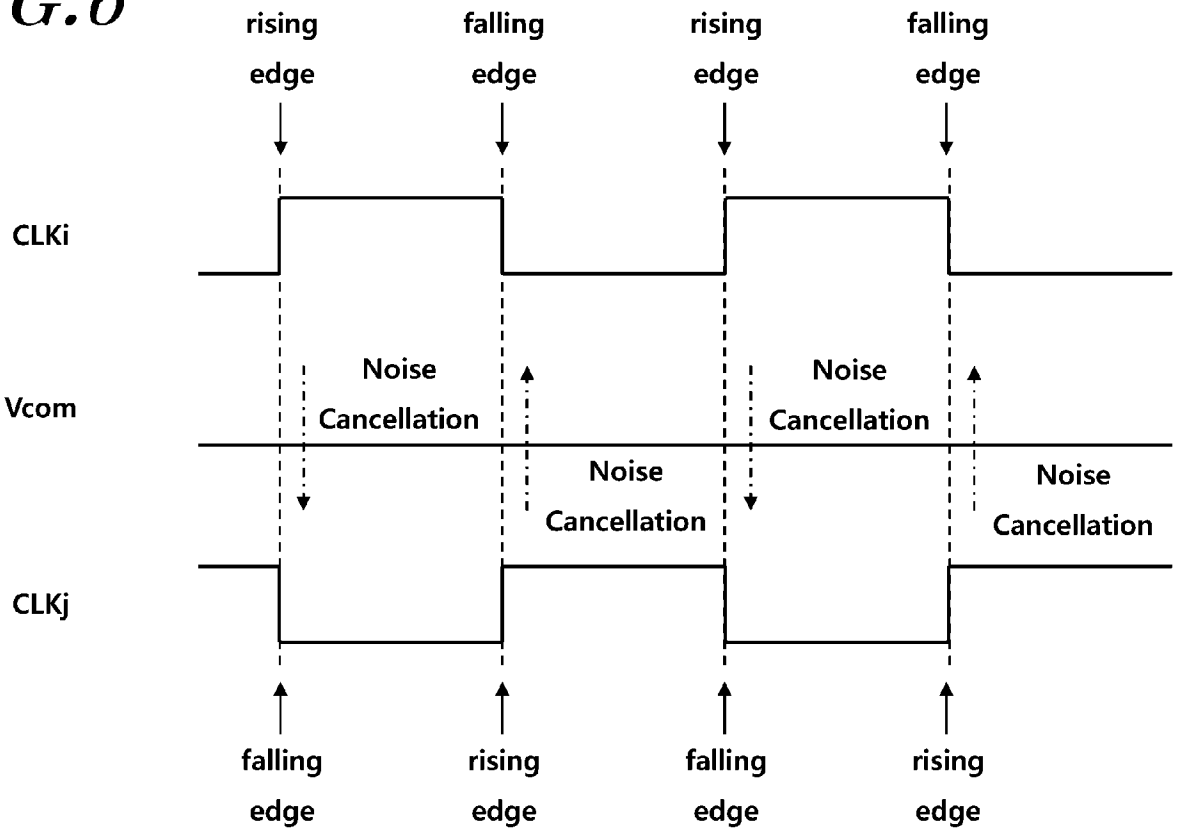
FIG. 6 is a diagram conceptually illustrating noise cancellation.

FIG. 6 is a diagram conceptually illustrating noise cancellation.

Referring to FIG. 6, the i-th clock signal CLKi and the j-th clock signal CLKj have opposite waveforms to each other. In such a waveform, noise generated at a rising edge of the i-th clock signal CLKi may be canceled out by a falling edge of the j-th clock signal CLKj. In addition, noise generated at a rising edge of the j-th clock signal CLKj may be canceled out by a falling edge of the i-th clock signal CLKi.

In relation to generation of a plurality of clock signals, the gate driving circuit according to an embodiment may generate a plurality of clock signals such that a voltage rising section of one clock signal, for example, a rising edge, is synchronized with a voltage falling section of another clock signal, for example, a falling edge.

Figure 7:
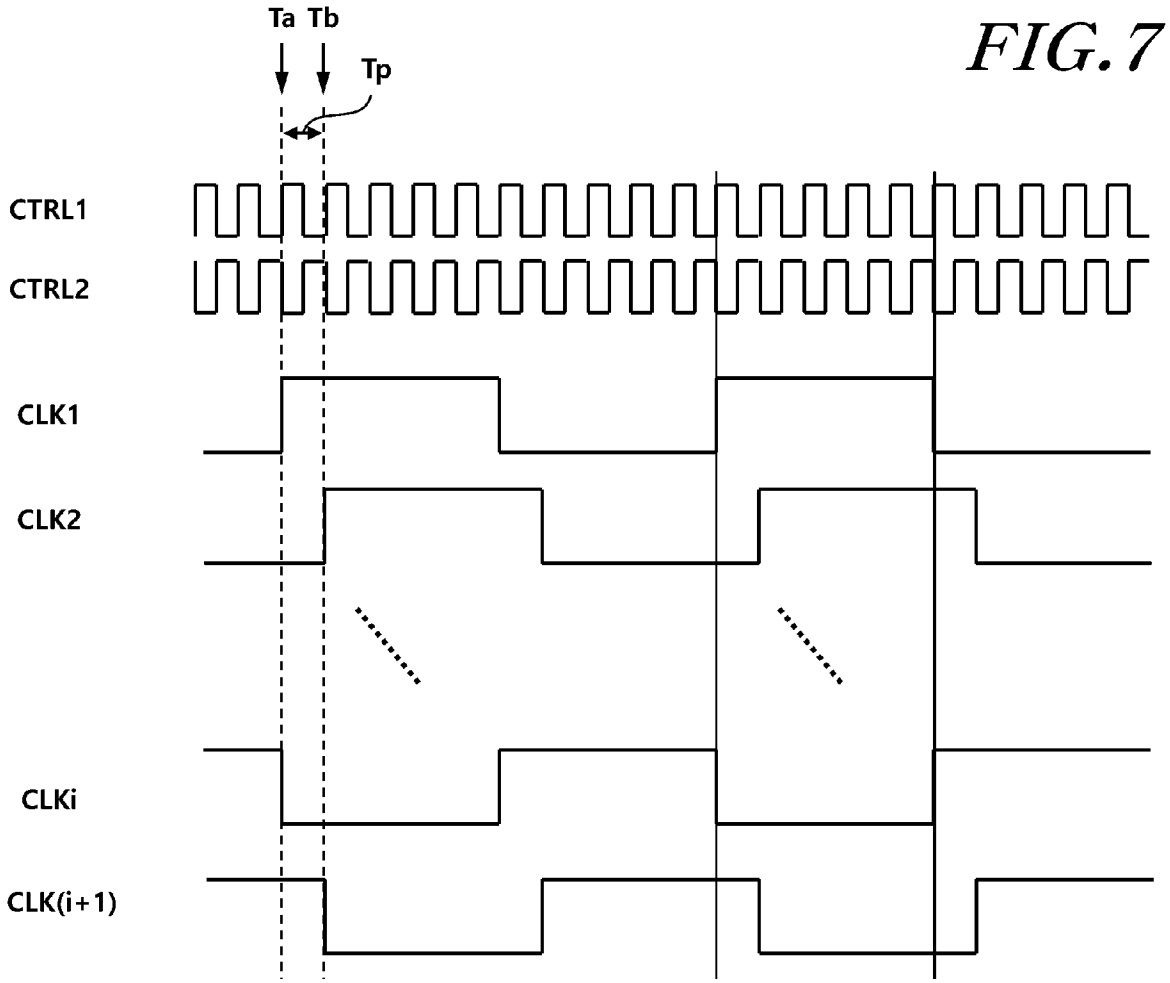
FIG. 7 is a diagram illustrating exemplary waveforms of a clock control signal and a clock signal.

On the other hand, the plurality of clock signals may be generated according to a clock control signal received from the timing controller. FIG. 7 shows exemplary waveforms of a clock control signal and a clock signal.

Referring to FIG. 7, the gate driving circuit (for example, a clock generation unit) may form voltage rising sections of clock signals (CLK1, CLK2, . . . , CLKi, CLK(i+1), . . . ) in synchronization with a rising edge of the first clock control signal CTRL1, and form voltage falling sections of clock signals (CLK1, CLK2, . . . , CLKi, CLK(i+1), . . . ) in synchronization with a falling edge of the second clock signal CTRL2.

At this time, a rising edge of the first clock control signal CTRL1 and a falling edge of the second clock control signal CTRL2 may be synchronized. As described above, when a rising edge of the first clock control signal CTRL1 is synchronized with a falling edge of the second clock control signal CTRL2, the gate driving circuit forms the voltage rising section and the voltage falling section of the clock signals (CLK1, CLK2, . . . , CLKi, CLK(i+1),) according to the first clock control signal CTRL1 and the second clock control signal CTRL2, so that a voltage rising section of one clock signal is automatically synchronized with a voltage falling section of another clock signal.

The first clock control signal CTRL1 and the second clock control signal CTRL2 may be pulse width modulation (PWM) signals. In the PWM signal, the first clock control signal CTRL1 and the second clock control signal CTRL2 have repeated rising and falling edges with a predetermined period Tp.

The gate driving circuit (e.g., a clock generating unit) may form one voltage rising section of a clock signal for each rising edge of the first clock control signal CTRL1, the rising edge being formed at every period. For example, the gate driving circuit may form one rising edge of a clock signal for each rising edge of the first clock control signal CTRL1 in such a manner that a rising edge of the first clock signal CLK1 is formed according to a rising edge of the first clock control signal CTRL1, the rising edge being formed at the first time point Ta, and a rising edge of the second clock control signal CLK2 is formed at the second time point Tb, which is the next rising edge of the first clock control signal CTRL1.

The gate driving circuit (e.g., a clock generating unit) may form one voltage falling section of a clock signal for each falling edge of the second clock control signal CTRL2, the falling edge being formed at every period. For example, the gate driving circuit may form a falling edge of the i-th clock signal CLKi according to a falling edge of the second clock control signal CTRL2, the falling edge being formed at the first time point Ta, and a falling edge of the (i+1)-th clock signal CLK(i+1) is formed at the second time point Tb, which is the next falling edge of the second clock control signal CTRL2.

The first clock control signal CTRL1 and the second clock control signal CTRL2 may be pulse width modulation (PWM) signals having the same period Tp. Since a voltage rising section of the first clock signal CLK1 and a voltage falling section of the i-th clock signal CLKi are synchronized at the first time point Ta, and a voltage rising section of the second clock signal CLK2 and a voltage falling section of the (i+1)-th clock signal CLK(i+1) are synchronized at the second time point Tb, which is the next period of the first clock control signal CTRL1 and the second clock control signal CTRL2, the first clock control signal CTRL1 and the second clock control signal CTRL2 have the same period Tp.

On the other hand, the gate driving circuit (for example, the clock generation unit) may generate a voltage rising section and/or a voltage falling section in two stages for the respective clock signals.

Figure 8A:
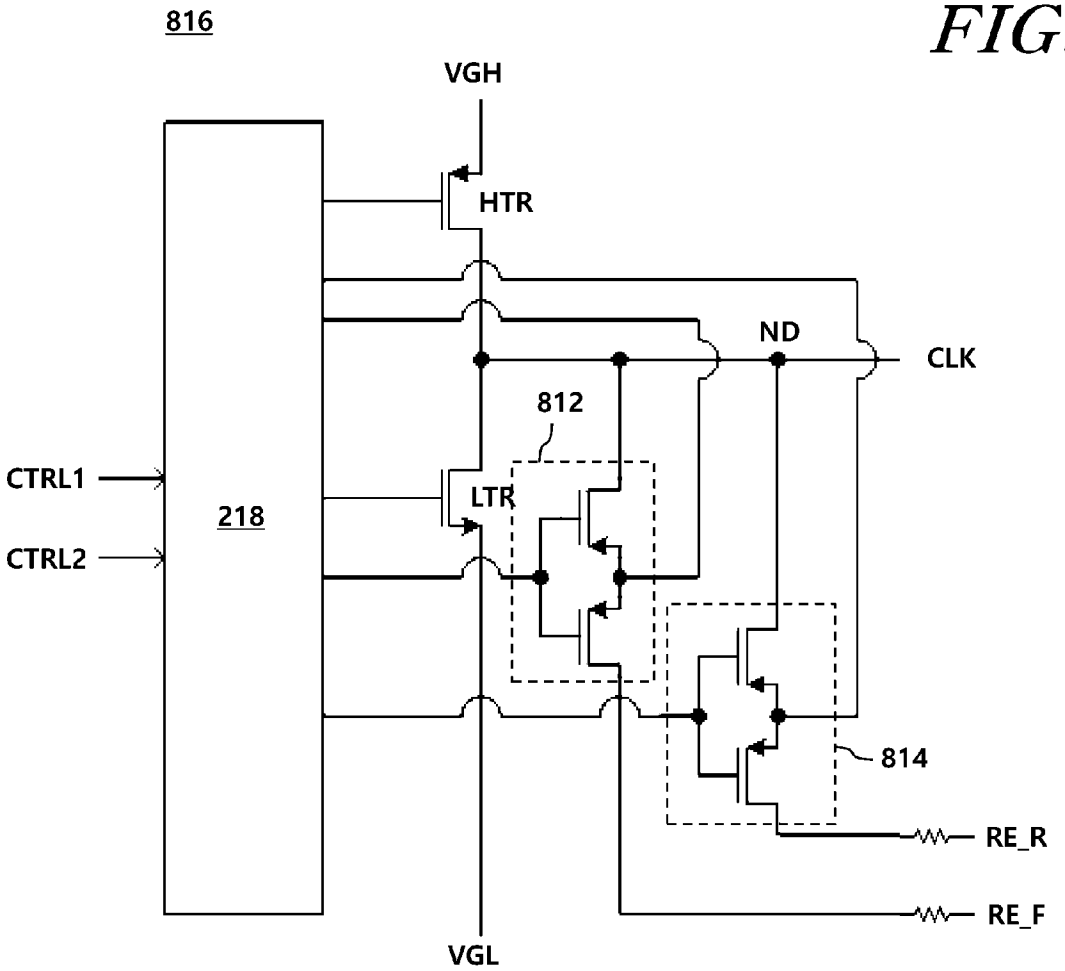
FIG. 8A is a block diagram of a channel forming a voltage rising section and a voltage falling section in two stages.

FIG. 8A is a block diagram of a channel forming a voltage rising section and a voltage falling section in two stages.

Referring to FIG. 8A, a channel 816 may include an upper transistor HTR, a lower transistor LTR, and a channel control unit 218, and further include two transistor units 812 and 814.

The transistor units 812 and 814 may be configured by an N-channel transistor and a P-channel transistor, which are connected in series, but are not limited thereto.

The two transistor units 812 and 814 may connect intermediate stage edge signals RE_R and RE_F to a node ND from which the clock signal CLK is output.

For example, when the first transistor unit 812 is turned on, the intermediate stage falling edge signal RE_F is connected to the output node ND. The intermediate stage falling edge signal RE_F provides a voltage between a high voltage VGH and a low voltage VGL. Accordingly, the clock signal CLK which is in a state of the high voltage VGH forms a two-stage voltage falling section during which the clock signal CLK falls to the low voltage VGL through the intermediate stage voltage.

As another example, when the second transistor unit 814 is turned on, the intermediate stage rising edge signal RE_R is connected to the output node ND. The intermediate stage rising edge signal RE_R provides a voltage between the high voltage VGH and the low voltage VGL. Accordingly, the clock signal CLK which is in a state of the low voltage VGL forms a two-stage voltage rising section during which the clock signal CLK increases to the high voltage VGH through the intermediate stage voltage.

Only one transistor unit may be included. For example, only the second transistor unit 814 for forming a voltage rising section in two stages may be included in the channel 816, and only the first transistor unit 812 for forming the voltage falling section in two stages may be included in the channel 816.

The intermediate stage edge signals may be the same signal. For example, the intermediate stage rising edge signal RE_R and the intermediate stage falling edge signal RE_F may be the same signal.

The intermediate stage edge signals RE_R and RE_F may be direct current (DC) voltages. When the intermediate stage edge signals RE_R and RE_F are DC voltages, the DC voltage is output to the output node as the transistor units 812 and 814 are turned on. At this time, the intermediate stage edge signals RE_R and RE_F may rise or fall while forming a certain slope through an impedance circuit (for example, a resistor). The impedance value of the impedance circuit is varied by a user so that the slope of the rising or falling edge may be adjusted by the user.

The transistor unit and the intermediate stage edge signal may be configured by one transistor unit and one intermediate stage edge signal, respectively. For example, one transistor unit may be used in both a voltage rising section and a voltage falling section to form an intermediate stage voltage in each of the voltage rising section and the voltage falling section.

Figure 8B:
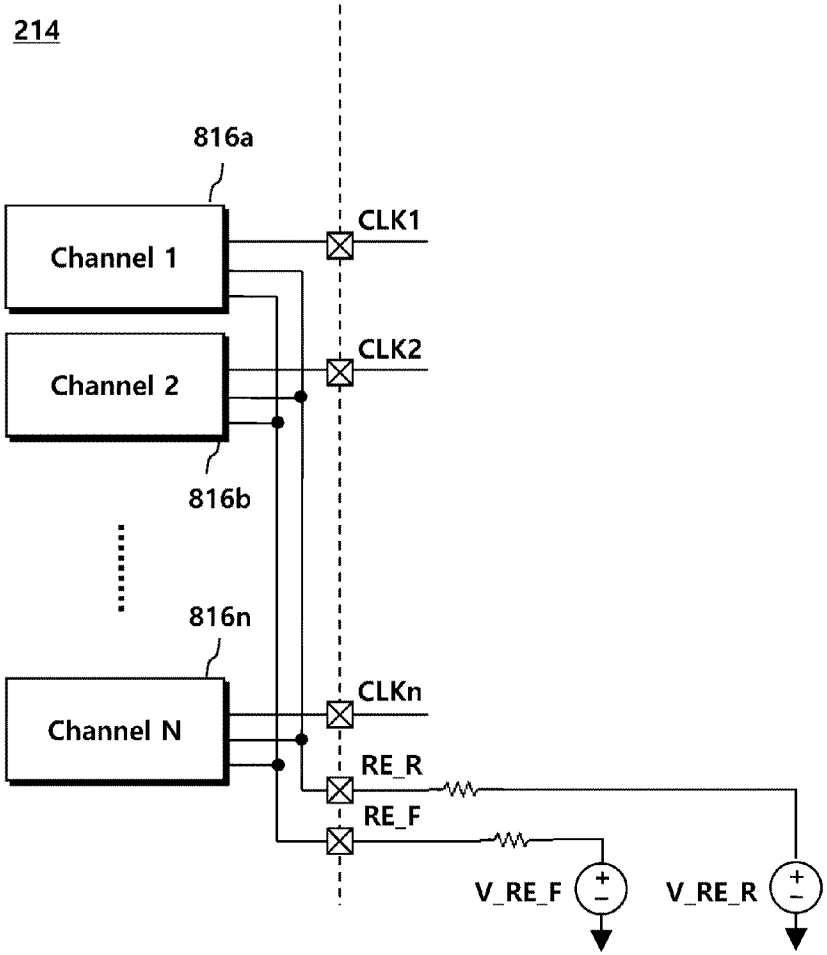
FIG. 8B is a diagram illustrating a first example of a level shifting unit in which two external terminals for controlling an intermediate stage edge signal are formed.

FIG. 8B is a first exemplary diagram of a level shifting unit in which two external terminals for controlling an intermediate stage edge signal are formed.

Referring to FIG. 8B, each of the channels (816*a*, 816*b*, . . . , and 816*n*) may form a two-stage voltage rising section and a two-stage voltage falling section, using the intermediate stage edge signals RE_R and RE_F. At this time, the level shifting unit 214 has two external terminals, and may receive the intermediate stage edge signals RE_R and RE_F through these two external terminals.

One terminal of the level shifting unit 214 may be externally connected to a voltage source V_RE_F that generates an intermediate stage falling edge signal RE_F and a resistor, and internally connected to each of channels (816*a*, 816*b*, . . . , 816*n*) in common.

In addition, another one terminal of the level shifting unit 214 may be externally connected to a voltage source V_RE_F that generate an intermediate stage falling edge signal RE_F and a resistor, and internally connected to each of channels (816*a*, 816*b*, . . . , 816*n*) in common.

In addition, each of the channels (816*a*, 816*b*, . . . , 816*n*) forms a two-stage voltage rising section and a two-stage voltage falling section by using the intermediate-stage edge signals RE_R and RE_F received from the respective voltage sources V_RE_R and V_RE_F.

Figure 9:
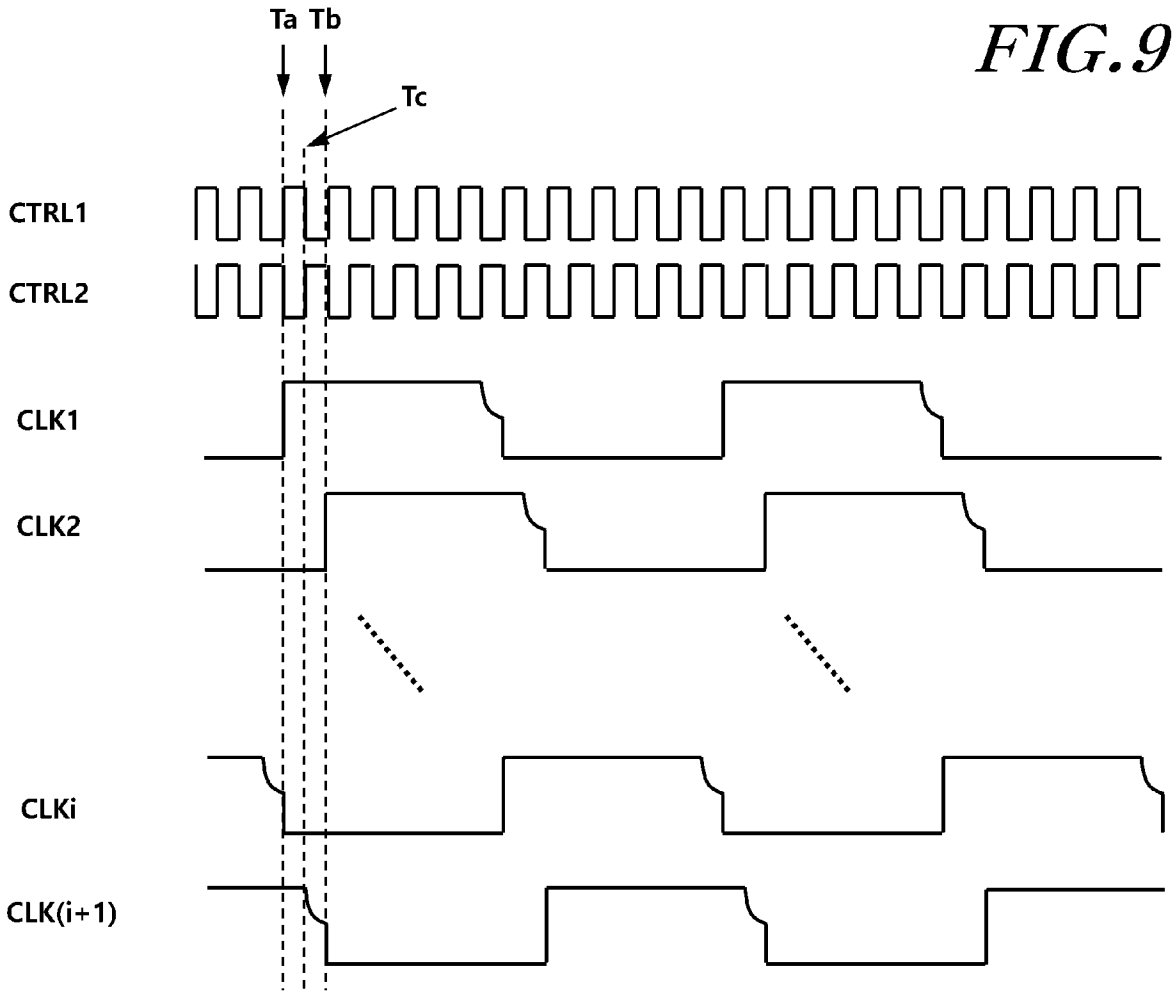
FIGS. 9 to 11 are diagrams illustrating exemplary waveforms of a clock signal and a clock control signal in which two stages of a voltage rising section and two stages of a voltage falling section are formed.
Figure 10:
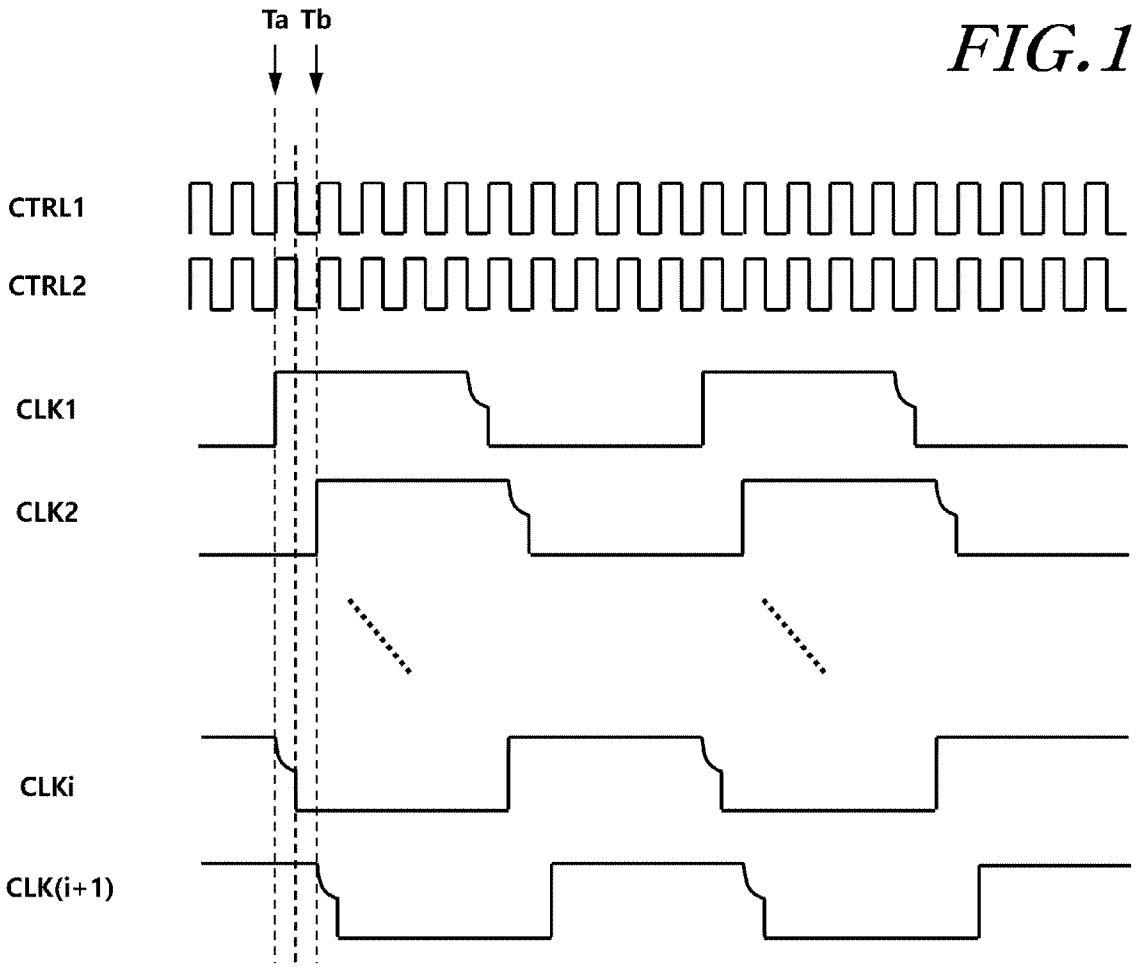
Figure 11:
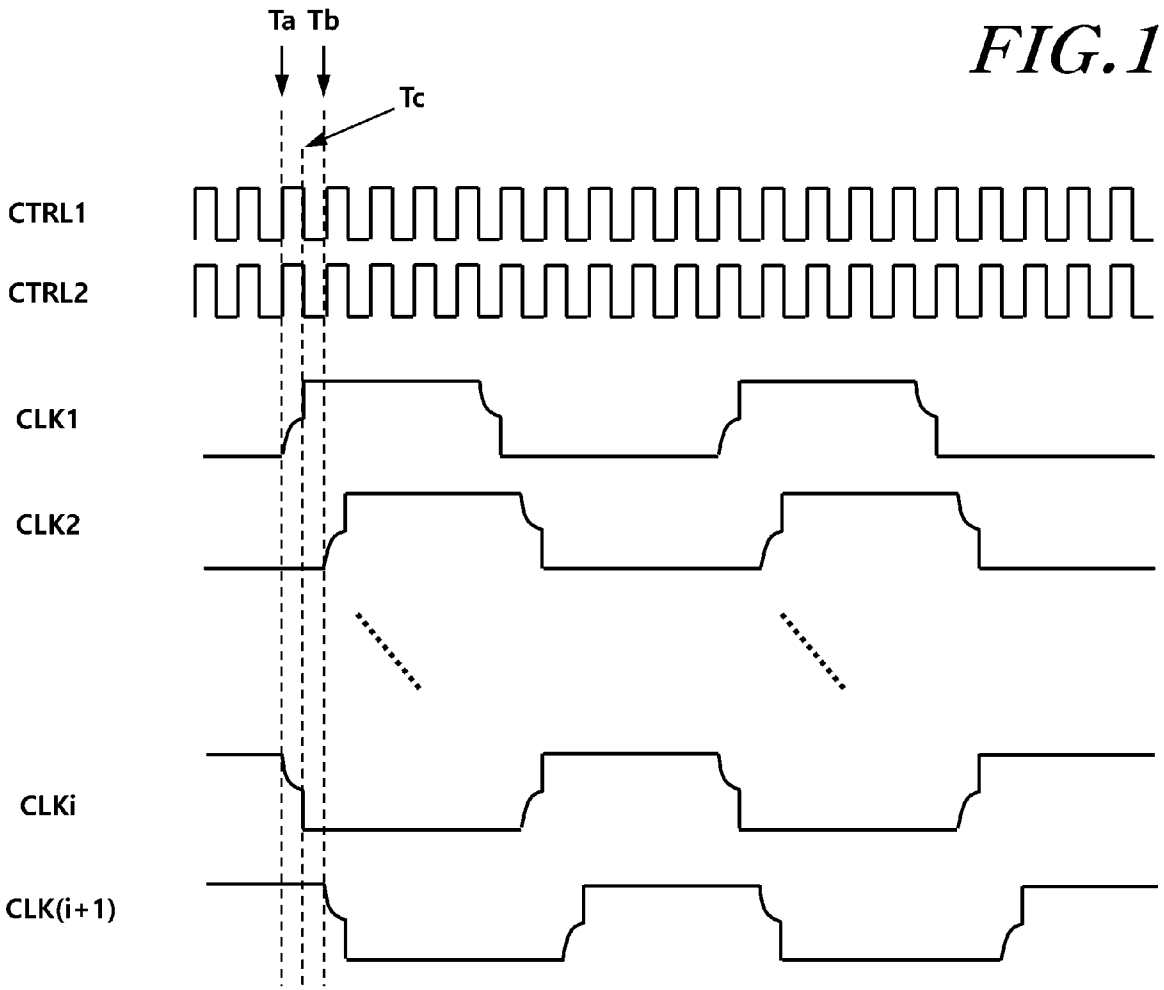

FIGS. 9 to 11 are diagrams illustrating exemplary waveforms of a clock signal and a clock control signal which form a two-stage voltage rising section and a two-stage voltage falling section.

Referring to FIG. 9, the gate driving circuit 130 generates a first voltage falling section of clock signals (CLK1, CLK2, . . . , CLKi, CLK(i+1), . . . ) in synchronization with a rising edge of the second clock control signal CTRL2, and generates a second voltage falling section of the clock signals (CLK1, CLK2, . . . , CLKi, CLK(i+1), . . . ) in synchronization with a falling edge of the second clock control signal CTRL2.

For example, the gate driving circuit may generate a first voltage falling section of the (i+1)-th clock signal CLK(i+1) at the third time point Tc at which a rising edge of the second clock control signal CTRL2 is formed, and may generate a second voltage falling section of the (i+1)-th clock signal CLK(i+1) at the second time point Tb at which a falling edge of the second clock control signal CTRL2 is formed.

The voltage rising section of one clock signal may be synchronized with the second voltage falling section of another clock signal.

For example, a voltage rising section of the first clock signal CLK1 may be formed at the first time point Ta at which a rising edge of the first clock control signal CTRL1 is formed, and a second voltage falling section of the i-th clock signal CLKi, may be formed at the first time point Ta at which a second falling edge of the i-th clock signal CLKi is formed. In the same manner, a voltage rising section of the second clock signal CLK2 is formed at the second time point Tb, and another second voltage falling section, which is a second voltage falling section of the (i+1)-th clock signal (CLK(i+1)), may be formed at the second time point Tb.

At this time, the first clock control signal CTRL1 and the second clock control signal CTRL2 may be a PWM signal having the same period and having a duty cycle of 50%.

Meanwhile, a voltage rising section of one clock signal may be synchronized with the first voltage falling section of another clock signal.

Referring to FIG. 10, the gate driving circuit 130 (for example, a clock generation unit) forms a voltage rising section of the clock signal in synchronization with a rising edge of the first clock control signal CTRL1. In addition, the gate driving circuit generates a first voltage falling section of clock signals (CLK1, CLK2, . . . , CLKi, CLK(i+1), . . . ) in synchronization with a rising edge of the second clock control signal CTRL2, and generates a second voltage falling section of the clock signals (CLK1, CLK2, . . . , CLKi, CLK(i+1), . . . ) in synchronization with a falling edge of the second clock control signal CTRL2.

When comparing the example shown in FIG. 9 and the example shown in FIG. 10, in the example shown in FIG. 9, the first clock control signal CTRL1 and the second clock control signal CTRL2 have a phase difference of 180 degrees, and in the example shown in FIG. 10, the first clock control signal CTRL1 and the second clock control signal CTRL2 have the same phase. According to another aspect, in the example shown in FIG. 9, a rising edge of the first clock control signal CTRL1 and a falling edge of the second clock control signal CTRL2 are synchronized. However, in the example shown in FIG. 10, a rising edge of the first clock control signal CTRL1 and a rising edge of the second clock control signal CTRL2 are synchronized.

According to the difference described above, in the example of FIG. 10, a voltage rising section of one clock signal is synchronized with a first voltage falling section, which is the first voltage falling section of another clock signal.

For example, a rising edge of the first clock signal CLK1 may be formed at the first time point Ta at which a rising edge of the first clock control signal CTRL1 is formed, and a first voltage falling section, which is the first voltage falling section of the i-th clock signal CLKi, may be formed at the first time point Ta. In the same manner, a rising edge of the second clock signal CLK2 may be formed at the second time point Tb, and another first voltage falling section, which is the first voltage falling section of the (i+1)-th clock signal (CLK(i+1)), may be formed at the second time point Tb.

On the other hand, the gate driving circuit (for example, the clock generation unit) may generate the voltage rising section and/or the voltage falling section in two stages for the respective clock signals.

Referring to FIG. 11, the gate driving circuit 130 forms a first voltage rising section, which is the first voltage rising section of each of the clock signals (CLK1, CLK2, . . . , CLKi, CLK(i+1), . . . ), in synchronization with a rising edge of the first clock control signal CTRL1, and generates a second voltage rising section, which is the second voltage rising section of each of the clock signals (CLK1, CLK2, . . . , CLKi, CLK(i+1), . . . ), in synchronization with a falling edge of the second clock control signal CTRL2. In addition, the gate driving circuit forms another first voltage falling section, which is the first voltage falling section of each of the clock signals (CLK1, CLK2, . . . , CLKi, CLK(i+1), . . . ), in synchronization with a rising edge of the second clock control signal CTRL2, and forms another second voltage falling section, which is the second voltage falling section of each of the clock signals (CLK1, CLK2, . . . , CLKi, CLK(i+1), . . . ), in synchronization with a falling edge of the second clock control signal CTRL2.

In the example of FIG. 11, the first voltage rising section of one clock signal is synchronized with the first voltage falling section of another clock signal, and the second voltage rising section of one clock signal is synchronized with the second voltage falling section of another clock signal.

As a specific example, the first voltage rising section of the first clock signal CLK1 and the first voltage falling section of the i-th clock signal CLKi are synchronized with each other at the first time point Ta, and the second voltage rising section of the first clock signal CLK1 and the second voltage falling section of the i-th clock signal CLKi are synchronized with each other at the third point of time Tc. In the same manner, a first voltage rising section of the second clock signal CLK2 and the first voltage falling section of the (i+1)-th clock signal (CLK(i+1)) are synchronized with each other at the second time point Tb.

Meanwhile, the gate driving signal supplying unit included in the gate driving circuit 130 may be formed using a gate in panel (GIP) method. In this case, a part of the clock line through which a clock signal is transmitted may also be formed in the display panel. At this time, since the clock line is directly coupled to neighboring electrodes, noise problems due to the clock signal may further occur.

Figure 12:
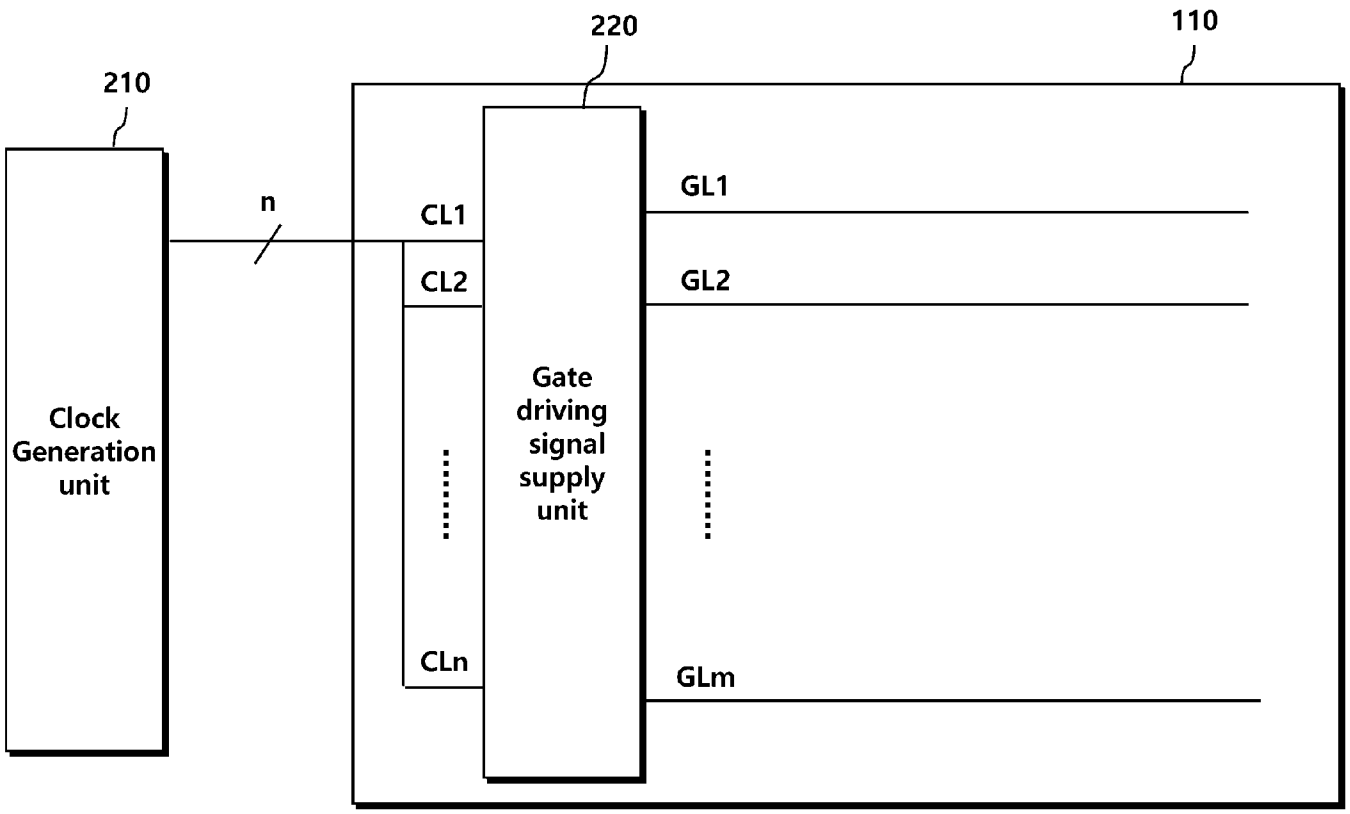
FIG. 12 is a diagram illustrating an example of the arrangement of a clock generation unit and a gate driving signal supplying unit.

FIG. 12 is a diagram illustrating an example of the arrangement of a clock generating unit and a gate driving signal supplying unit.

Referring to FIG. 12, a clock generation unit 210 may be disposed outside a display panel 110, and a gate driving signal supply unit 220 may be disposed on the display panel. In addition, the display panel 110 may include a plurality of clock lines (CL1, CL2, . . . , CLn) to which a clock signal is transmitted. The clock lines (CL1, CL2, . . . , CLn) formed on the display panel 110 are coupled to not only gate lines (GL1, GL2, . . . , GLm) but also other neighboring electrodes by capacitance, so that noise problems may further occur in the neighboring electrodes or neighboring elements.

In such a GIP scheme, the gate driving circuit can minimize the noise problem by synchronizing a voltage rising section of one clock signal of a plurality of clock signals with a voltage falling section of another clock signal.

In the above embodiment, an example of the clock generation unit 210 for generating a plurality of clock signals by using two clock control signals has been described. However, unlike the embodiment, the clock generation unit may receive a plurality of clock control signals, which is the same number as the plurality of clock signals, so as to generate clock signals.

Figure 13:
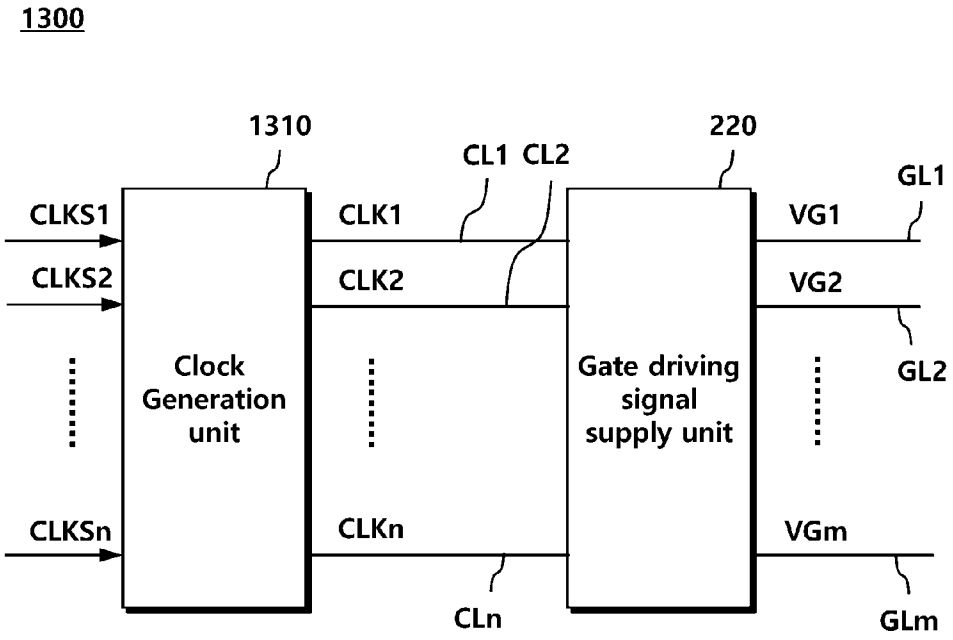
FIG. 13 is a block diagram of a gate driving circuit according to another embodiment.

FIG. 13 is a block diagram of a gate driving circuit according to another embodiment.

Referring to FIG. 13, the gate driving circuit 1300 includes a clock generation unit 1310 and a gate driving signal supply unit 220. The clock generation unit 1310 may receive a plurality of clock control signals (CLKS1, CLKS2, . . . , CLKSn), which is the same number as a plurality of clock signals (CLK1, CLK2, . . . , CLKn), and shift voltage levels of the clock control signals (CLKS1, CLKS2, . . . , CLKSn), so as to generate the clock signals (CLK1, CLK2, . . . , CLKn).

The gate driving circuit 1300 may generate a plurality of clock signals (CLK1, CLK2, . . . , CLKn) such that a voltage rising section of one clock signal of the plurality of clock signals (CLK1, CLK2, . . . , CLKn), for example, a rising edge and a voltage falling section of another clock signal, for example, a falling edge, are synchronized with each other. At this time, when a rising edge of one clock control signal of the clock control signals (CLKS1, CLKS2, . . . , CLKSn) is controlled to be synchronized with a falling edge of another clock control signal, the gate driving circuit 1300 may generate the clock signals (CLK1, CLK2, . . . , CLKn) in such a manner of simply shifting voltage levels of the clock control signals (CLKS1, CLKS2, . . . , CLKSn).

The clock control signals (CLKS1, CLKS2, . . . , CLKSn) may be received from a timing controller, and the timing controller may perform control such that a rising edge of one clock control signal of the plurality of clock control signals (CLKS1, CLKS2, . . . , CLKSn) is synchronized with a falling edge of another clock control signal.

Meanwhile, when the voltage level formed in a gate line is changed, electric charge charged in the capacitance formed between the gate line and neighboring electrodes may be discharged to generate heat in a discharge path. On the other hand, when the capacitance formed between the gate line and neighboring electrodes is not charged with electric charge, a large amount of power can be consumed in order to change the voltage level of the gate line.

The display device according to an embodiment of the present disclosure further includes a connection transistor unit including at least one transistor for connecting two gate lines, and may control electric charge of the capacitance which is formed between the gate line and the neighboring electrodes under the control of the connection transistor unit.

Figure 14:
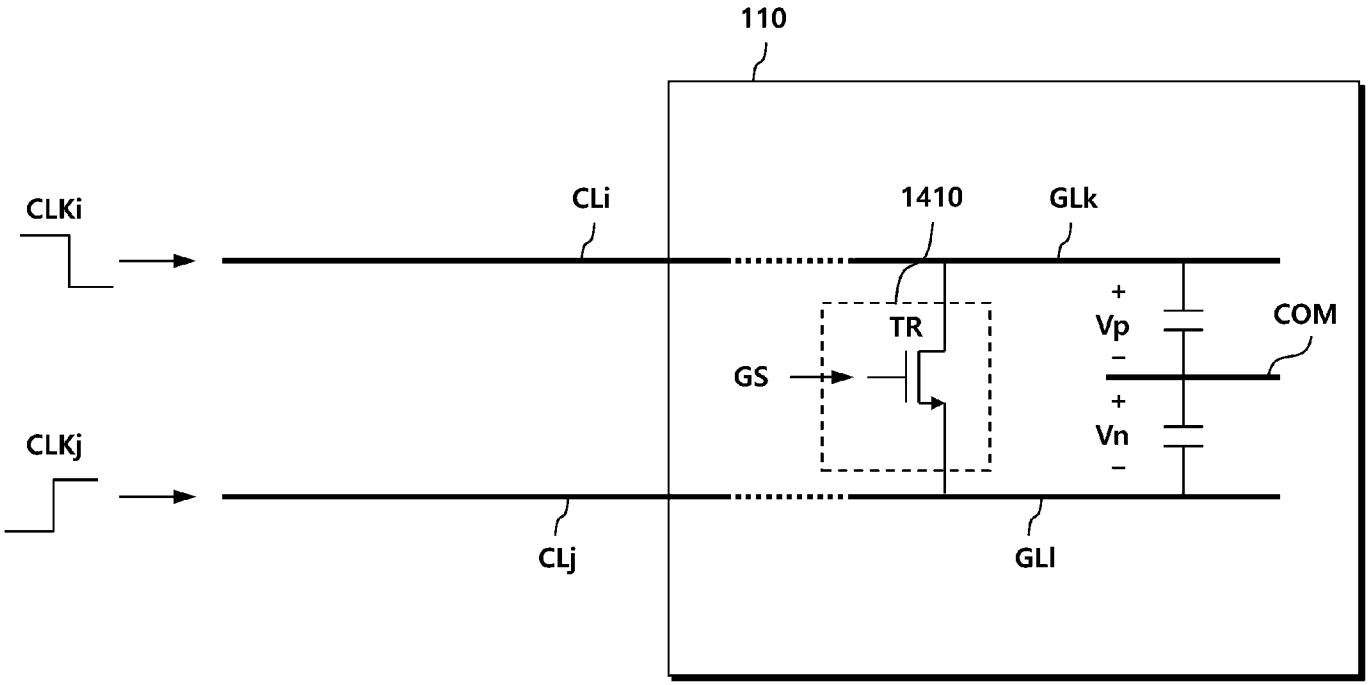
FIG. 14 is a diagram illustrating the arrangement of a connection transistor for connecting gate lines.

FIG. 14 is a diagram illustrating the arrangement of a connection transistor unit for connecting gate lines.

Referring to FIG. 14, a connection transistor unit 1410 for connecting two gate lines GLk and GLl may be disposed on the display panel 110.

In the example of FIG. 14, the connection transistor unit 1410 is shown as being configured by one transistor TR, but the connection transistor unit 1410 may further include other elements besides the transistor TR. For example, a plurality of transistors connected in parallel or in series may be disposed in the connection transistor unit 1410, and additional elements for controlling on/off of the transistor or controlling on/off time of the transistor may be further included therein.

In FIG. 14, a positive voltage Vp is applied between a k-th gate line GLk and a common electrode COM. In addition, a negative voltage Vn is applied between a l-th gate line GLl and the common electrode COM.

In a state where a positive voltage Vp is applied between the k-th gate line GLk and the common electrode COM, when a i-th clock signal CLKi having a voltage falling section, for example, a falling edge, is supplied through the i-th clock line CLi linked to the k-th gate line GLk, the i-th clock signal CLKi has to discharge all electric charges charged between the k-th gate line GLk and the common electrode COM. At this time, since electric charges charged between the k-th gate line GLk and the common electrode COM are discharged through the k-th gate line GLk and the i-th clock line CLi, heat generation and noise problems may occur in a long discharge path.

In a state where a negative voltage Vn is applied between the l-th gate line GLl and the common electrode COM, when a j-th clock signal CLKj having a voltage rising section, for example, a rising edge, is supplied through the j-th clock line CLj linked to the l-th gate line GU, the j-th clock signal CLKj have to fully charge the capacitance between the l-th gate line GLl and the common electrode COM. At this time, since electric charges charged between the l-th gate line GLl and the common electrode COM are charged through the l-th gate line GLl and the j-th clock line CLj, it may cause a large amount of power consumption, heat generation and noise problems in a long charge path.

The connection transistor unit 1410 may be disposed on the display panel 110 in order to shorten charging and discharging paths for the capacitance between the gate line and the neighboring electrodes and solve the power consumption, heat generation, and noise problems. The connection transistor unit 1410 temporarily connects the gate line GLk to which the positive voltage Vp is applied and the gate line GLl to which the negative voltage Vn is applied, so that electric charges between the two gate lines GLk and GLl are shared therebetween. When electric charges are shared between the two gate lines GLk and GLl, only a small amount of variation in the electric charge enables a clock signal having a rising edge or a falling edge to be transferred.

The connection transistor unit 1410 may be disposed between two gate lines. The two gate lines may be adjacent but may be located remotely.

The connection transistor unit 1410 may be located in the display panel 110. In particular, in a GIP structure, the connection transistor unit 1410 may be disposed between terminals from which the gate driving signal is output. However, the connection transistor unit 1410 may be disposed at another location. For example, the connection transistor unit 1410 may be located in a gate driver located outside the display panel 110.

A gate signal GS for controlling turn-on/turn-off of the connection transistor unit 1410 may be synchronized to a rising edge or a falling edge of the clock signals CLKi and CLKj.

Figure 15:
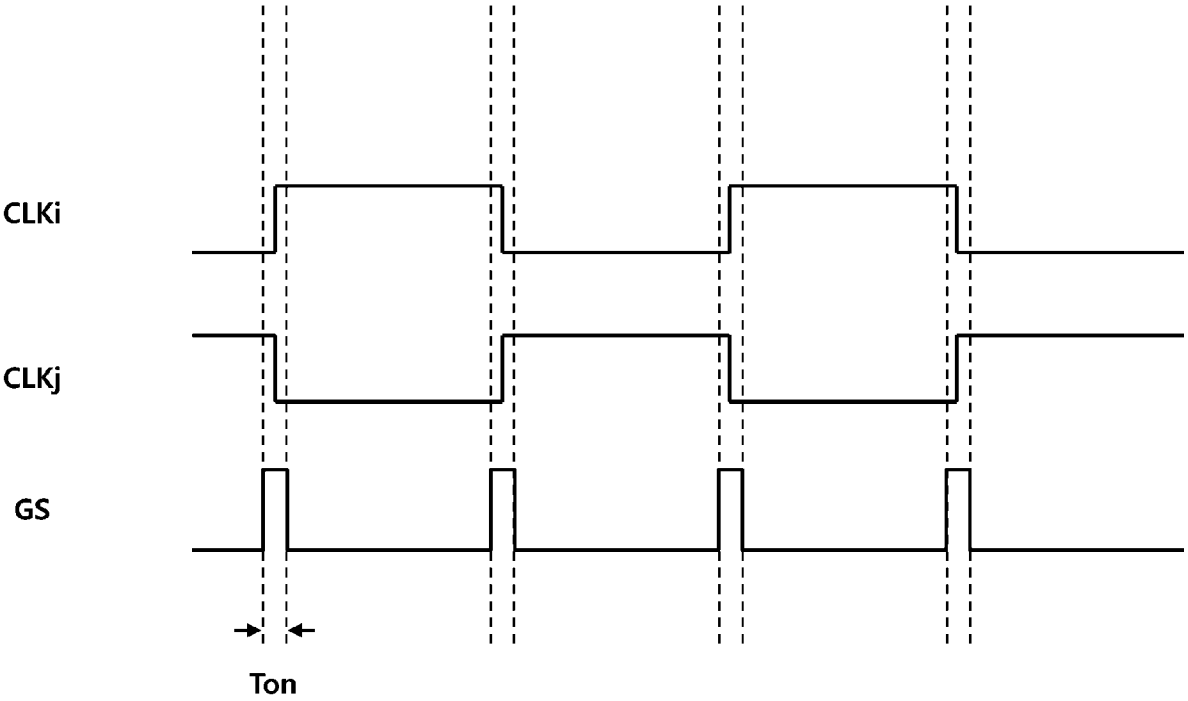
FIG. 15 is a diagram illustrating waveforms of a clock signal and a gate signal shown in FIG. 14.

FIG. 15 is a diagram illustrating waveforms of a clock signal and a gate signal shown in FIG. 14.

Referring to FIG. 15, a gate signal GS for controlling the connection transistor unit has a turn-on voltage in a section Ton, which is a voltage rising section for a clock signal CLKi and a voltage falling section for a clock signal CLKj.

The section Ton, which is a voltage rising section for a clock signal CLKi and a voltage falling section for a clock signal CLKj, may be a section from a start time point of the voltage variation to a completion time point of the voltage variation of the clock signals CLKi and CLKj, and may be a period having a certain margin before and after the voltage variation time point (rising edge and falling edge).

The gate signal GS may be generated in the gate driving circuit, and in particular, when the gate driving circuit has a GIP structure, the gate signal GS may be generated in synchronization with a rising edge or a falling edge of the clock signals CLKi and CLKj in the GIP circuit.

The gate driving circuit may connect two gate lines by controlling the connection transistor unit in a voltage rising section of the clock signals CLKi and CLKj or a voltage falling section of the clock signals CLKi and CLKj.

On the other hand, as an additional embodiment, an embodiment in which transistor units included in respective channels of the gate driving circuit are connected to each other will be described.

Figure 16:
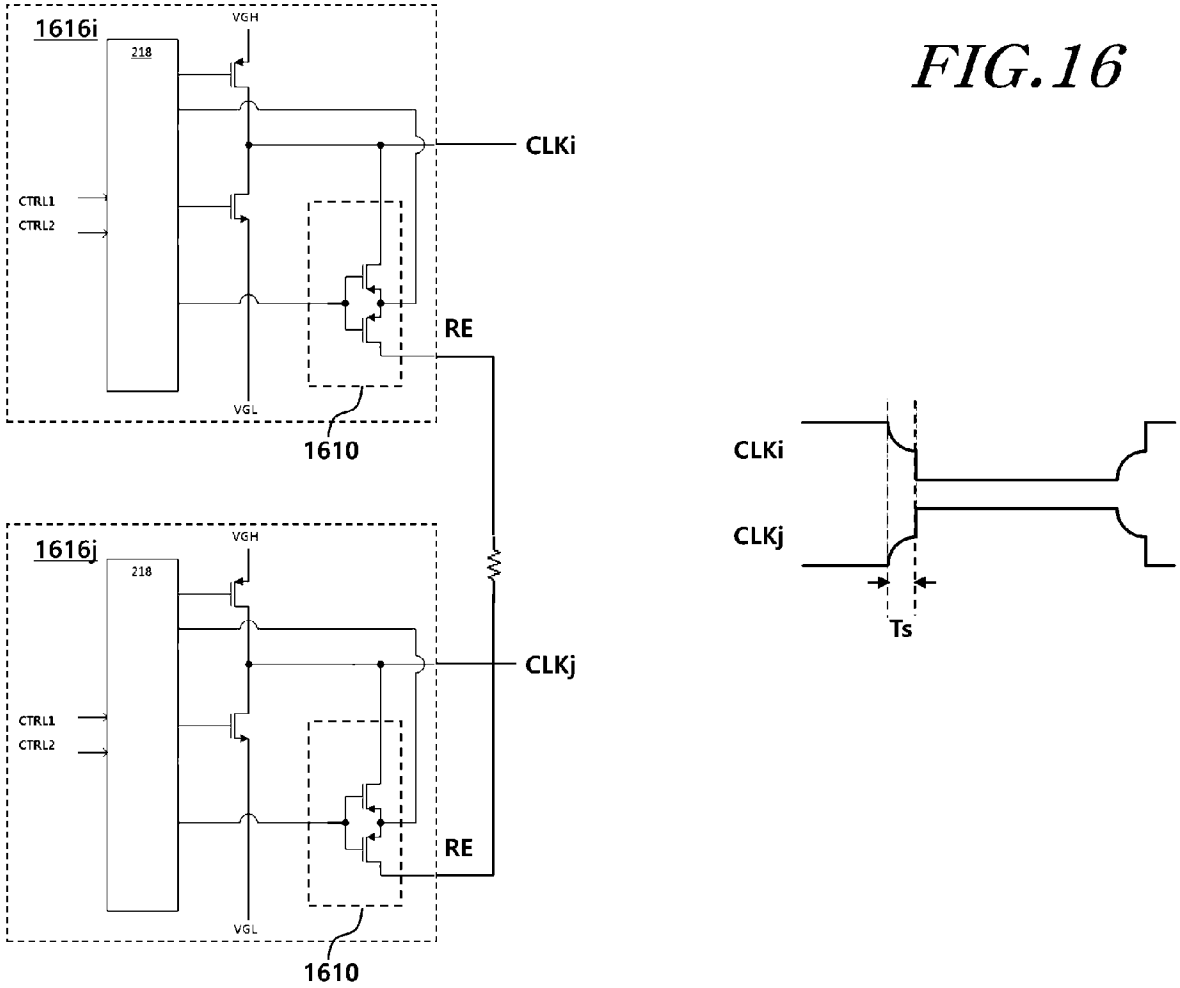
FIG. 16 shows an embodiment in which transistor units included in respective channels of a gate driving circuit are connected to each other.

FIG. 16 shows an embodiment in which transistor units included in respective channels of the gate driving circuit are connected to each other.

A transistor unit 1610 included in each channel may be used to form an intermediate stage voltage in a voltage rising section (e.g., a rising edge) or a voltage falling section (e.g., a falling edge). In the embodiment described with reference to FIG. 8, an example of outputting a clock signal of the intermediate stage voltage to a transistor unit of each channel when the transistor unit is turned on while being connected to a direct current voltage representing the intermediate stage voltage have been described. The example shown in FIG. 16 is an embodiment in which the direct current voltage is not supplied to the transistor unit 1610.

Referring to FIG. 16, outputs of the two channels **1616*i* and 1616*j* included in the gate driving circuit may be connected to each other by the transistor unit 1610 included in each channel. In addition, in a voltage falling section of an i-th channel 1616*i* clock signal and a voltage rising section of the j-th channel 1616*j* clock signal, the transistor unit 1610 is turned on and a clock signal of the i-th channel 1616*i* and a clock signal of the j-th channel 1616*j*** may form an intermediate stage voltage.

As a specific example, when the i-th channel **1616*i* outputs the high voltage VGH, the j-th channel 1616*j* outputs the low voltage VGL, and the transistor unit 1610 included in each channel is turned on for a specific time Ts, the output CLKi of the i-th channel 1616*i* has a voltage lowering from the high voltage VGH state, and the output CLKj of the j-th channel 1616*j* has a voltage rising from the low voltage VGL state, and the two outputs CLKi and CLKj become an intermediate stage voltage. When each transistor unit 1610** is connected through impedance, the slope of the voltage variation may be adjusted according to the impedance value.

The gate driving circuit may form a voltage rising section and a voltage falling section in two stages in such a manner.

Figure 17:
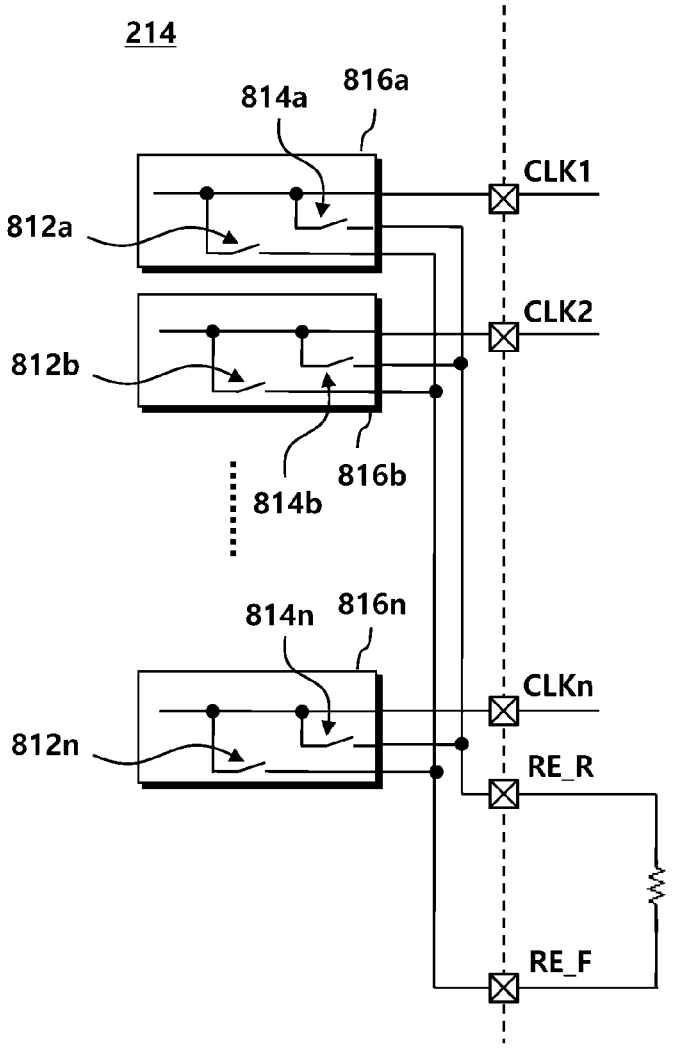
FIG. 17 is a diagram illustrating an example of a level shifting unit in which two external terminals for controlling an intermediate stage edge signal are formed.

FIG. 17 is an exemplary diagram of a level shifting unit in which two external terminals for controlling an intermediate stage edge signal are formed.

Referring to FIG. 17, respective channels (816*a*, 816*b*, . . . , 816*n*) form an intermediate stage voltage while being connected to each other. At this time, the level shifting unit 214 has two external terminals, and the two external terminals are connected to each other through a resistor.

The channels (816*a*, 816*b*, . . . , 816*n*) include first transistor units (812*a*, 812*b*, . . . , 812*n*) forming intermediate stage falling edges and second transistor units (814*a*, 814*b*, . . . , 814*n*) forming an intermediate stage rising edges.

In addition, the first transistor units (812*a*, 812*b*, . . . , 812*n*) and the second transistor units (814*a*, 814*b*, . . . , 814*n*), which are located in different channels, are connected to each other, thereby forming an intermediate stage voltage in the respective channels (816*a*, 816*b*, . . . , 816*n*). For example, when the first channel 816*a* outputs the high voltage VGH, the second channel 816*b* outputs the low voltage VGL, and the first transistor unit 812*a* of the first channel 816*a* and the second transistor unit 814*b* of the second channel 816*b* are turned on for a specific time Ts, the output CLK1 of the first channel 816*a* has a voltage lowering from the high voltage VGH state, and the output CLK2 of the second channel 816*b* has a voltage rising from the low voltage VGL state, and the two outputs CLK1 and CLK2 become an intermediate stage voltage. In addition, the slope of the voltage change can be adjusted according to the impedance value connected to the external terminal.

In the above, the embodiments of the present invention have been described. According to the embodiment, a voltage rising section of one clock signal is synchronized with a voltage falling section of another clock signal, so that noise having occurred at the neighboring electrodes (for example, the common electrode) can be attenuated. In addition, there is an effect of improving power consumption, heat generation, noise problems, and the like by controlling a connection transistor and the like.

In addition, since terms, such as "including," "comprising," and "having" mean that one or more corresponding components may exist unless they are specifically described to the contrary, it shall be construed that one or more other components can be included. All the terms that are technical, scientific or otherwise agree with the meanings as understood by a person skilled in the art unless defined to the contrary. Common terms as found in dictionaries should be interpreted in the context of the related technical writings not too ideally or impractically unless the present invention expressly defines them so.

Although a preferred embodiment of the present invention has been described for illustrative purposes, those skilled in the art will appreciate that various modifications, additions and substitutions are possible, without departing from the scope and spirit of the invention as disclosed in the accompanying claims. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A gate driving circuit comprising:

a control signal reception unit for receiving a first clock control signal and a second clock control signal from a timing controller;

a level shifting unit for generating a plurality of clock signals having voltage levels different from those of the first clock control signal and the second clock control signal, each of the plurality of clock signals including at least one voltage rising section, which is formed in synchronization with the first clock control signal, and at least one voltage falling section, which is formed in synchronization with the second clock control signal; and a gate driving signal supply unit for supplying a gate driving signal generated according to the plurality of clock signals to a plurality of gate lines disposed on a display panel, wherein each of the gate lines is coupled to one electrode disposed on the display panel by capacitance, and one voltage rising section of one clock signal of the plurality of clock signals is synchronized with one voltage falling section of another one clock signal, wherein a common electrode is disposed on the display panel, and the common electrode and the gate lines are coupled with each other by capacitance.

2. The gate driving circuit of claim 1, wherein the level-shifting unit connects a node from which each clock signal is output to an intermediate voltage through a resistor in a first voltage rising section, and connects the node to a high voltage in a second voltage rising section.

3. The gate driving circuit of claim 1, wherein the level shifting unit connects a node from which the one clock signal is output and a node from which the another one clock signal is output, through a resistor, in the one voltage rising section of the one clock signal and the one voltage falling section of the another one clock signal.

4. The gate driving circuit of claim 1, wherein a first voltage rising section of the at least one voltage rising section is formed in synchronization with a rising edge of the first clock control signal, and a second voltage rising section is formed in synchronization with a falling edge of the first clock control signal.

5. The gate driving circuit of claim 1, wherein a first voltage falling section of the at least one voltage falling section is formed in synchronization with a rising edge of the second clock control signal, and a second voltage falling section is formed in synchronization with a falling edge of the second clock control signal.

6. The gate driving circuit of claim 5, wherein the one voltage rising section of the one clock signal is synchronized with the first voltage falling section or the second voltage falling section of the another one clock signal.

7. The gate driving circuit of claim 6, wherein the first clock control signal and the second clock control signal are pulse width modulation (PWM) signals of 50% duty.

8. The gate driving circuit of claim 1, wherein the plurality of clock signals have a first voltage rising section and a second voltage rising section which are formed in two stages, and have a first voltage falling section and a second voltage falling section which are formed in two stages, and the first voltage rising section and the second voltage rising section of the one clock signal are synchronized with the first voltage falling section and the second voltage falling section of the another one clock signal, respectively.

9. The gate driving circuit of claim 1, wherein one voltage rising section of the another one clock signal is synchronized with one voltage falling section of the one clock signal.

10. A level shifter comprising:

a control signal reception unit for receiving a first clock control signal and a second clock control signal from a timing controller; and a level shifting unit for generating a plurality of clock signals having voltage levels different from those of the first clock control signal and the second clock control signal, each of the plurality of clock signals including at least one voltage rising section, which is formed in synchronization with the first clock control signal, and at least one voltage falling section, which is formed in synchronization with the second clock control signal, wherein a gate driving signal generated according to the plurality of clock signals is supplied to a plurality of gate lines disposed on a display panel, each of the gate lines is coupled to one electrode disposed on the display panel by capacitance, and one voltage rising section of one clock signal of the plurality of clock signals is synchronized with one voltage falling section of another one clock signal, wherein a common electrode is disposed on the display panel, and the common electrode and the gate lines are coupled with each other by capacitance.

11. The level shifter of claim 10, wherein the one voltage rising section of the one clock signal is synchronized with a rising edge of the first clock control signal, the one voltage falling section of the another one clock signal is synchronized with a falling edge of the second clock control signal, and the rising edge of the first clock control signal and the falling edge of the second clock control signal are synchronized with each other.

12. The level shifter of claim 10, wherein the first clock control signal and the second clock control signal are pulse width modulation (PWM) signals having the same period.

13. A display device comprising:

a timing controller for transmitting a first clock control signal and a second clock control signal;

a display panel on which a plurality of gate lines coupled to one electrode by capacitance are arranged; and a gate driving circuit for generating a plurality of clock signals having voltage levels different from those of the first clock control signal and the second clock control signal, each of the plurality of clock signals including at least one voltage rising section, which is formed in synchronization with the first clock control signal, and at least one voltage falling section, which is formed in synchronization with the second clock control signal, and for supplying a gate driving signal generated according to the plurality of clock signals to the plurality of gate lines, wherein one voltage rising section of one clock signal of the plurality of clock signals is synchronized with one voltage falling section of another one clock signal, wherein a common electrode is disposed on the display panel, and the common electrode and the gate lines are coupled with each other by capacitance.

14. The display device of claim 13, wherein the gate driving circuit comprises:

a clock generation unit for generating the plurality of clock signals; and a gate driving signal supply unit for generating the gate driving signal according to the plurality of clock signals, and supplying the gate driving signal to the gate line, wherein the gate driving signal supply unit is disposed on the display panel, and the clock generation unit is disposed on the outside of the display panel, and the display panel includes a plurality of clock lines through which the plurality of clock signals are transmitted.

15. The display device of claim 13, wherein the display panel further comprises a connection transistor unit for connecting two gate lines, and the gate driving circuit controls the connection transistor unit in one voltage rising section or one voltage falling section of the plurality of clock signals, so as to connect the two gate lines.

16. The display device of claim 13, wherein a channel for outputting the one clock signal and a channel for outputting the another one clock signal are connected to each other by a transistor unit included in each channel, and the one clock signal and the another one clock signal form an intermediate stage voltage while the transistor unit is turned on in one voltage rising section of the one clock signal and one voltage falling section of the another one clock signal.

* * * * *